US010247185B2

(12) United States Patent
Moreno et al.

(10) Patent No.: US 10,247,185 B2
(45) Date of Patent: Apr. 2, 2019

(54) FLUID PUMP

(71) Applicant: DELPHI TECHNOLOGIES IP LIMITED, St. Michael (BB)

(72) Inventors: Alejandro Moreno, El Paso, TX (US); Hector R. Mendoza, CD Juarez (MX)

(73) Assignee: DELPHI TECHNOLOGIES IP LIMITED (BB)

( * ) Notice: Subject to any disclaimer, the term of this patent is extended or adjusted under 35 U.S.C. 154(b) by 686 days.

(21) Appl. No.: 14/630,956

(22) Filed: Feb. 25, 2015

(65) Prior Publication Data

US 2016/0245284 A1 Aug. 25, 2016

(51) Int. Cl.

| | |
|---|---|
| ***F04C 2/10*** | (2006.01) |
| ***F04C 2/02*** | (2006.01) |
| ***F04C 13/00*** | (2006.01) |
| ***F04C 15/06*** | (2006.01) |
| ***F04D 29/40*** | (2006.01) |
| ***F04D 29/42*** | (2006.01) |
| ***F04D 29/52*** | (2006.01) |
| *F04D 13/08* | (2006.01) |
| *F04D 13/06* | (2006.01) |
| *F04C 15/00* | (2006.01) |

(52) U.S. Cl.

CPC ..... *F04C 2/103* (2013.01); *F04C 2/02* (2013.01); *F04C 13/008* (2013.01); *F04C 15/06* (2013.01); *F04D 29/406* (2013.01); *F04D 29/4293* (2013.01); *F04D 29/528* (2013.01); *F04C 2/102* (2013.01); *F04C 15/0049* (2013.01); *F04C 2210/1044* (2013.01); *F04C 2280/02* (2013.01); *F04D 13/06* (2013.01); *F04D 13/086* (2013.01)

(58) Field of Classification Search

CPC .... F04C 2/08; F04C 2/10; F04C 2/103; F04C 15/06; F04C 2280/02; F04C 2210/1044; F04C 13/008; F04D 13/06; F04D 29/406; F04D 29/426; F04D 29/4293; F04D 29/4273; F04D 29/528; F04B 17/03

USPC ..... 417/423.9, 423.14, 424.1, 410.4, 410.1, 417/366, 369, 370, 423.8

See application file for complete search history.

(56) References Cited

U.S. PATENT DOCUMENTS 5,509,778 A * 4/1996 Hantle ..... F04D 5/002 415/169.1
6,082,984 A * 7/2000 Matsumoto ..... F02M 37/041 415/55.1
6,769,889 B1 8/2004 Raney et al.
(Continued)

*Primary Examiner* — Alexander Comley
(74) *Attorney, Agent, or Firm* — Joshua M. Haines

(57) ABSTRACT

A fluid pump includes a housing; an outlet; an inlet plate within the housing and having an inlet; an outlet plate disposed within the housing and having an outlet plate outlet passage; an electric motor which rotates about an axis; a pumping arrangement rotationally coupled to the electric motor such that rotation of the pumping arrangement causes fluid to be pumped from the inlet to the outlet plate outlet passage and through the outlet; a diverter plate between the outlet plate outlet passage and the electric motor and having a diverter passage which provides fluid communication from the outlet plate outlet passage, past the electric motor, to the outlet, the diverter plate also having an imperforate wall which is axially aligned with the outlet plate outlet passage such that the imperforate wall laterally directs fluid from the outlet passage to the diverter passage.

21 Claims, 5 Drawing Sheets

(56) References Cited

U.S. PATENT DOCUMENTS

| | | | | |
|---|---|---|---|---|
| 8,556,568 | B2 | 10/2013 | Fischer | |
| 2014/0314591 | A1* | 10/2014 | Herrera | F04D 13/06<br>417/410.1 |

* cited by examiner

FLUID PUMP

TECHNICAL FIELD OF INVENTION

The present invention relates to a fluid pump which pumps fluid; more particularly to a fuel pump which pumps fuel; even more particularly fuel pump including a diverter plate which minimizes pressure pulsation transmission and prevents foreign matter present in the fuel from depositing in a pumping arrangement of the fuel pump.

BACKGROUND OF INVENTION

Fluid pumps, and more particularly fuel pumps for pumping fuel, for example, from a fuel tank of a motor vehicle to an internal combustion engine of the motor vehicle, are known. A typical fuel pump includes a housing within which generally includes a pump section, a motor section, and an outlet section. The pump section includes an inlet plate, an outlet plate, and a pumping arrangement between the inlet plate and the outlet plate. The pumping arrangement is rotated by an electric motor located in the motor section, thereby causing fuel to be drawn into the housing through an inlet of the inlet plate and through an outlet passage of the outlet plate. The fuel then passes past the electric motor and exits the housing through an outlet of the outlet section. The fuel pump may be an impeller type fuel pump where the pumping arrangement is an impeller as shown in U.S. Pat. No. 8,556,568 to Fisher, the disclosure of which is incorporated herein by reference in its entirety or the fuel pump may be a gerotor-type fuel where the pumping arrangement is an inner gear rotor surrounded by an outer gear rotor as shown in U.S. Pat. No. 6,769,889 to Raney et al., the disclosure of which is incorporated herein by reference in its entirety. Alternatively, the fuel pump may be a vane-type fuel pump, a gear-type fuel pump, or a roller vane-type fuel pump.

Fuel pumps as described above are typically oriented with the pumping section oriented down, i.e. in the direction of gravity, while the outlet section is oriented up, i.e. away from gravity. Consequently, when the fuel pump is not operating, particulate matter that may be present in the fuel that has already exited the outlet passage of the outlet plate may settle downward, passing through the outlet passage of the outlet plate and depositing in the pumping arrangement. Foreign matter that settles in the pumping arrangement may lead to binding, fracturing, and increased wear of the pumping arrangement when the fuel pump is subsequently operated. Furthermore, the physics associated with the pumping arrangement moving the fuel from the inlet plate to the outlet plate may generate pressure pulsations which may propagate through the structure of the fuel pump, hoses, and fuel surrounding the fuel pump which may produce undesirable noise.

What is needed is a fuel pump which minimizes or eliminates one or more of the shortcomings as set forth above.

SUMMARY OF THE INVENTION

Briefly described, a fluid pump includes a housing; an outlet which discharges fluid from the housing; an inlet plate disposed within the housing, the inlet plate having an inlet which introduces fluid to the housing; an outlet plate disposed within the housing, the outlet plate having an outlet plate outlet passage; an electric motor disposed within the housing between the outlet plate and the outlet, the electric motor having a shaft which rotates about an axis; a pumping arrangement rotationally coupled to the shaft such that rotation of the pumping arrangement by the shaft causes fluid to be pumped from the inlet to the outlet plate outlet passage and through the outlet; a diverter plate disposed between the outlet plate outlet passage and the electric motor, the diverter plate having a diverter passage which provides fluid communication from the outlet plate outlet passage, past the electric motor, to the outlet, the diverter plate also having an imperforate wall which is axially aligned with the outlet plate outlet passage such that the imperforate wall laterally directs fluid from the outlet passage to the diverter passage. The imperforate wall of the diverter plate prevents foreign matter that may be present in the fuel from passing through the outlet plate outlet passage and depositing in the pumping arrangement when the fluid pump is not operating. The diverter plate also mitigates pressure pulsations generated by the pumping arrangement, thereby minimizing noise generated by the fluid pump.

BRIEF DESCRIPTION OF DRAWINGS

This invention will be further described with reference to the accompanying drawings in which.

DETAILED DESCRIPTION OF INVENTION

Figure 1:
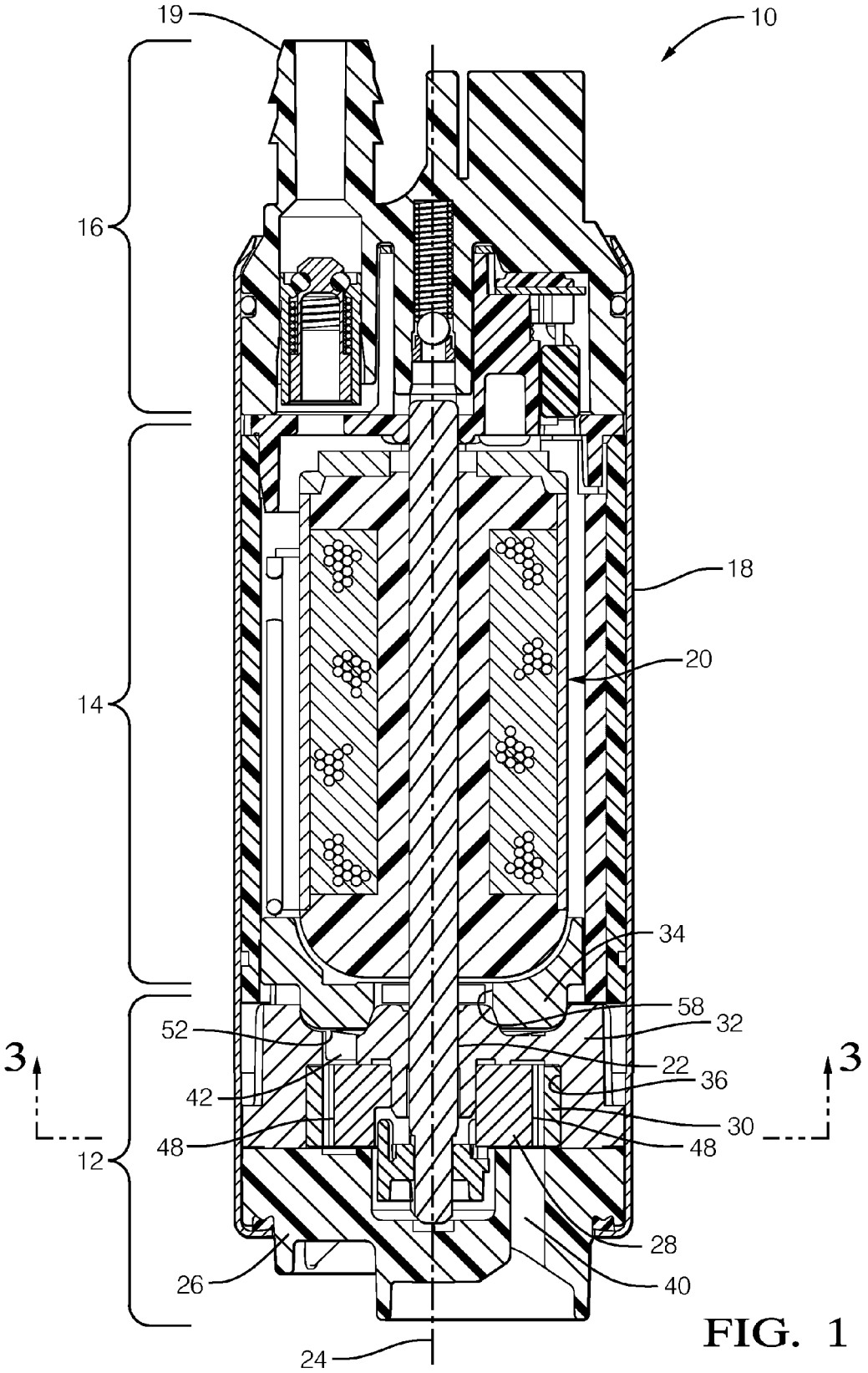
FIG. 1 is an axial cross-sectional view of a fluid pump in accordance with the present invention.
Figure 2:
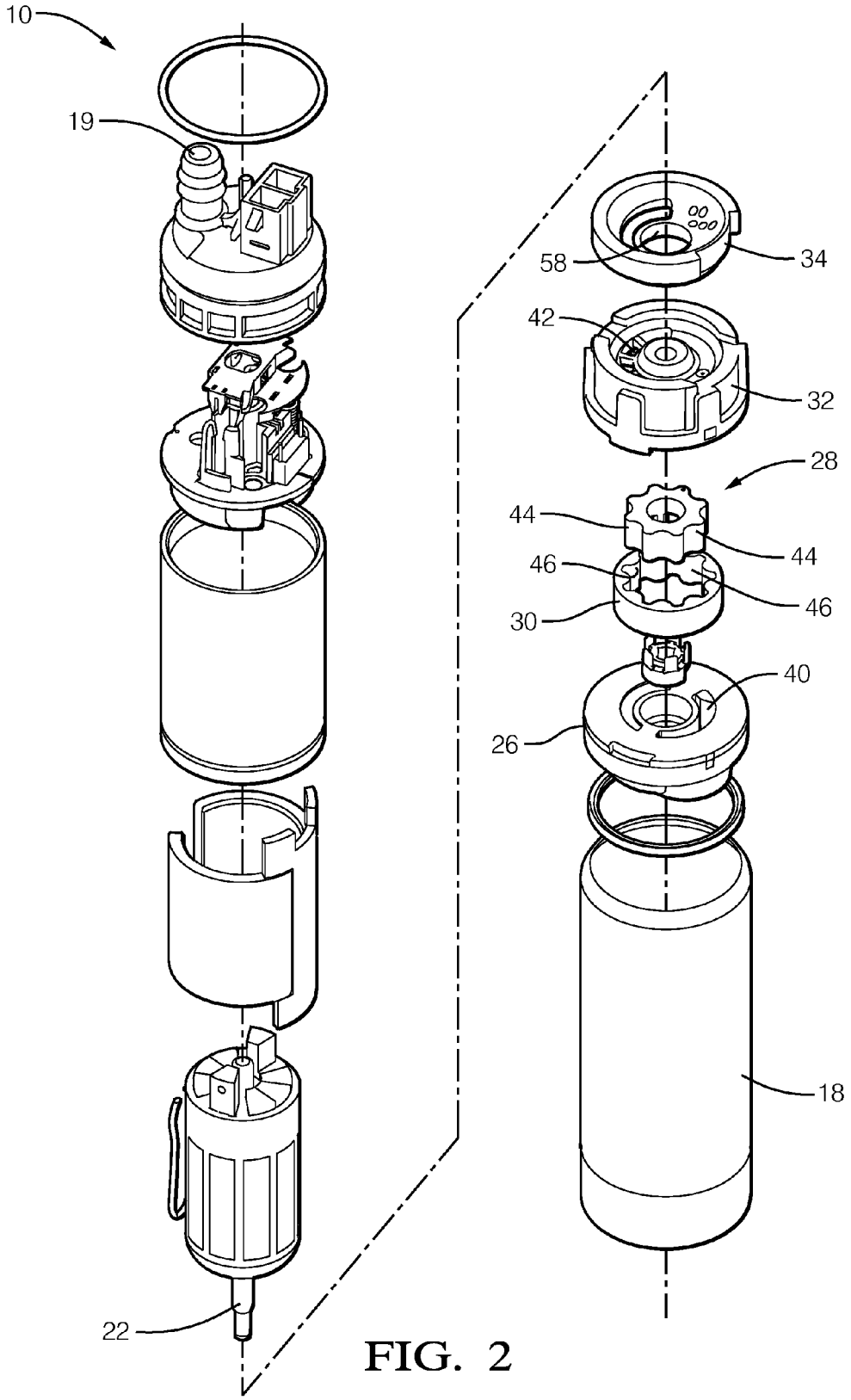
FIG. 2 is an exploded isometric view of the fluid pump of FIG. 1.
Figure 3:
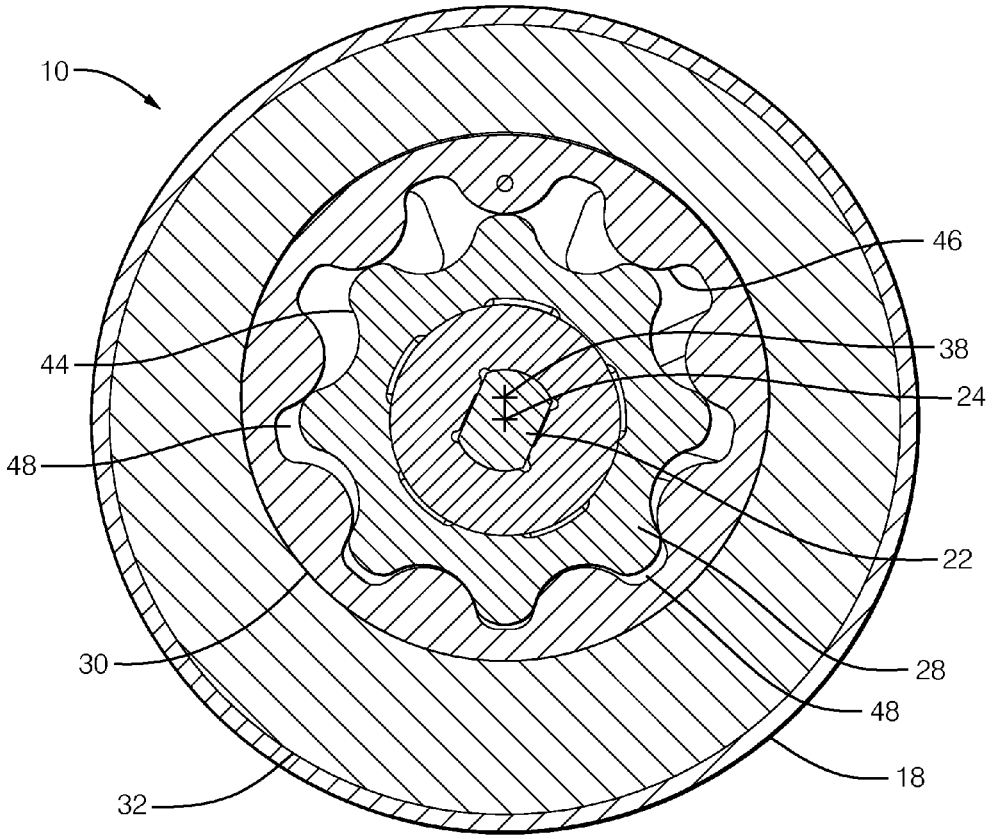
FIG. 3 is a radial cross-sectional view of the fluid pump of FIG. 1 taken through an inner gear rotor and an outer gear rotor of the fluid pump.
Figure 4:
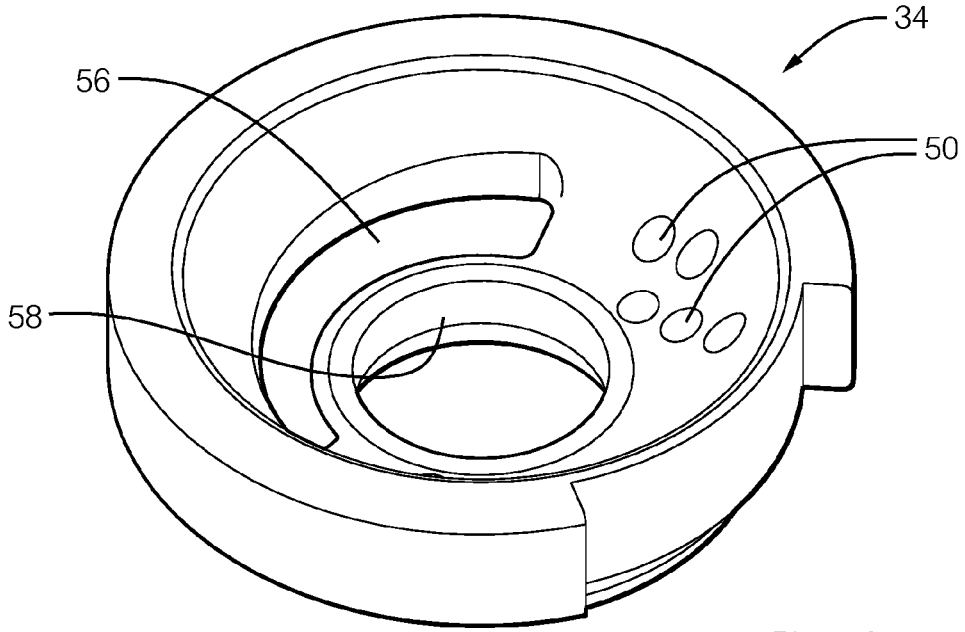
FIG. 4 is an isometric view of a diverter plate of the fluid pump of FIG. 1.
Figure 5:
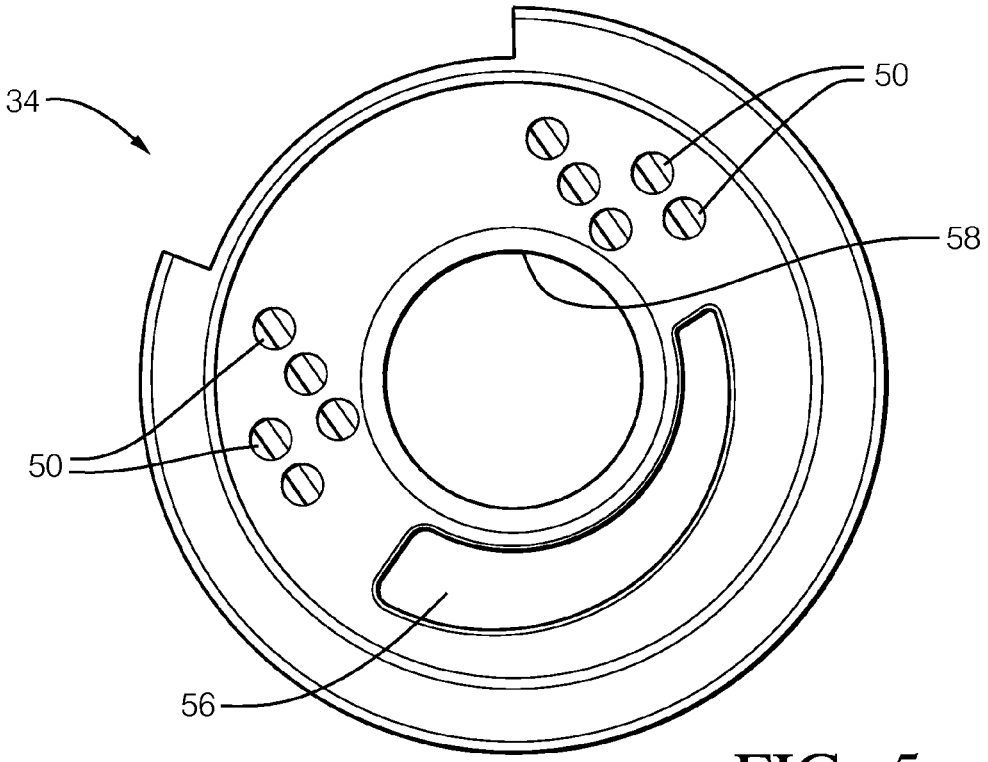
FIG. 5 is an elevation view of the diverter plate of FIG. 4.
Figure 6:
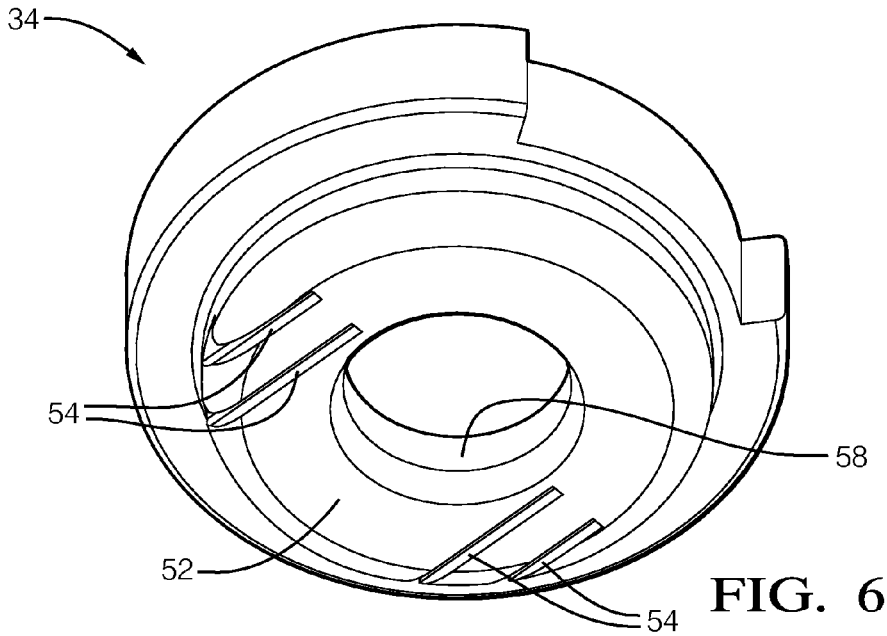
FIG. 6 is another isometric view of the diverter plate of FIG. 4.
Figure 7:
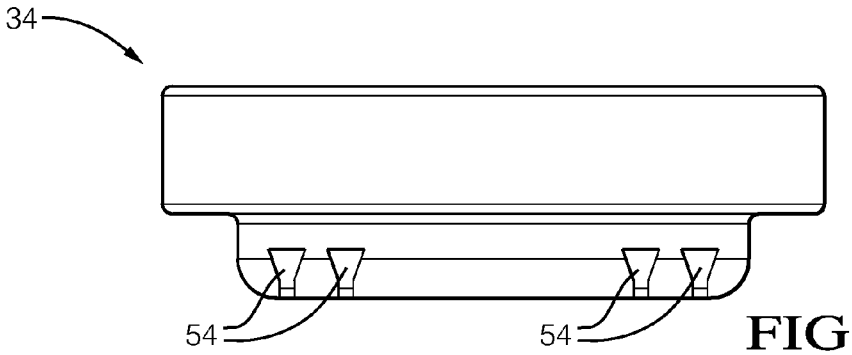
FIG. 7 is another elevation view of the diverter plate of FIG. 4.
Figure 8:
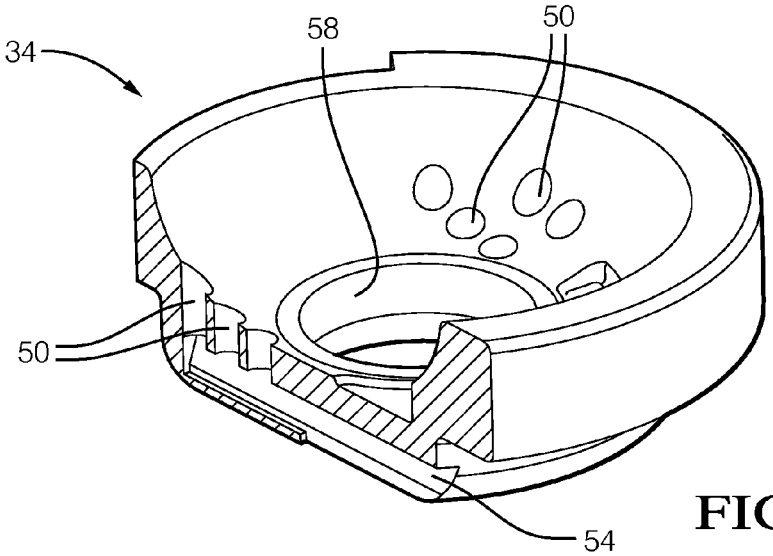
FIG. 8 is an isometric cross-sectional view of the diverter plate of FIG. 4.

Reference will first be made to FIGS. 1 and 2 which are an axial cross-sectional view and an exploded isometric view respectively of a fluid pump illustrated as a fuel pump 10 for pumping liquid fuel, by way of non-limiting example only gasoline or diesel fuel, from a fuel tank (not shown) to an internal combustion engine (not shown). While the fluid pump is illustrated as fuel pump 10, it should be understood that the invention is not to be limited to a fuel pump, but could also be applied to fluid pumps for pumping fluids other than fuel. Fuel pump 10 generally includes a pump section 12 at one end, a motor section 14 adjacent to pump section 12, and an outlet section 16 adjacent to motor section 14 at the end of fuel pump 10 opposite pump section 12. A housing 18 of fuel pump 10 retains pump section 12, motor section 14 and outlet section 16 together. Fuel enters fuel pump 10 at pump section 12, a portion of which is rotated by motor section 14 as will be described in more detail later, and is pumped past motor section 14 to outlet section 16 where the fuel exits fuel pump 10 through an outlet 19 of outlet section 16.

Motor section 14 includes an electric motor 20 which is disposed within housing 18. Electric motor 20 includes a shaft 22 extending therefrom into pump section 12. Shaft 22 rotates about a first axis 24 when an electric current is applied to electric motor 20. Electric motors and their operation are well known, consequently, electric motor 20 will not be discussed further herein. Electric motor 20 may be configured as shown in United State Patent Application Publication No. US 2014/0314591 A1 to Herrera et al., the disclosure of which is incorporated herein by reference in its entirety.

With continued reference to FIGS. 1 and 2 and now with additional reference to FIGS. 3-8, pump section 12 includes an inlet plate 26, a pumping arrangement illustrated as an inner gear rotor 28 and an outer gear rotor 30, an outlet plate 32, and a diverter plate 34. Inlet plate 26 is disposed at the end of pump section 12 that is distal from motor section 14 while diverter plate 34 is disposed at the end of pump section 12 that is proximal to motor section 14 such that outlet plate 32 is located axially between inlet plate 26 and diverter plate 34. Inner gear rotor 28 and an outer gear rotor 30 are rotatably disposed within a gear rotor bore 36 which extends into outlet plate 32 from the face of inner gear rotor 28 that abuts inlet plate 26. Gear rotor bore 36 is centered about a second axis 38 (best shown in FIG. 3) which is parallel and laterally offset relative to first axis 24. Gear rotor bore 36 is diametrically sized to allow outer gear rotor 30 to rotate freely therein while substantially preventing radial movement of outer gear rotor 30. Inlet plate 26 includes an inlet 40 which extends therethrough to provide fluid communication from the outside of fuel pump 10 to gear rotor bore 36 while outlet plate 32 includes an outlet plate outlet passage 42 which extends therethrough to provide fluid communication from gear rotor bore 36 to diverter plate 34.

Inner gear rotor 28 includes a plurality of external teeth 44 on the outer perimeter thereof which engage complementary internal tooth recesses 46 of outer gear rotor 30, thereby defining a plurality of variable volume pumping chambers 48 between inner gear rotor 28 and outer gear rotor 30. It should be noted that only representative external teeth 44, internal tooth recesses 46 and pumping chambers 48 have been labeled in the drawings. As shown, inner gear rotor 28 has eight external teeth 44 while outer gear rotor 30 has nine internal tooth recesses 46, however, it should be understood that inner gear rotor 28 may have any number n external teeth 44 while outer gear rotor 30 has n+1 internal tooth recesses 46. Inlet 40 of inlet plate 26 is aligned with a portion of gear rotor bore 36 within which the geometry between external teeth 44 and internal tooth recesses 46 create pumping chambers 48 of relative large size while outlet plate outlet passage 42 of outlet plate 32 is aligned with a portion of gear rotor bore 36 within which the geometry between external teeth 44 and internal tooth recesses 46 create pumping chambers 48 of relatively small size. Inner gear rotor 28 is rotationally coupled to shaft 22, consequently, when electric motor 20 is rotated by application of an electric current, inner gear rotor 28 rotates about first axis 24. By virtue of external teeth 44 engaging internal tooth recesses 46, rotation of inner gear rotor 28 causes outer gear rotor 30 to rotate about second axis 38. In this way, the volume of pumping chambers 48 decreases as each pumping chamber 48 rotates from being in communication with inlet 40 to being in communication with outlet plate outlet passage 42, thereby causing fuel to be pressurized and pumped from inlet 40 to outlet plate outlet passage 42.

Diverter plate 34 segregates the portion of housing 18 which houses pump section 12 from the portion of housing 18 which houses electric motor 20, consequently, diverter plate 34 is disposed between outlet plate outlet passage 42 and electric motor 20. Diverter plate 34 includes a diverter passage 50 which provides fluid communication from outlet plate outlet passage 42 and past electric motor 20 to outlet 19. As shown, diverter passage 50 may be comprised of a plurality of individual diverter passages 50 which extend axially through diverter plate 34. Diverter plate 34 also includes an imperforate wall 52 which is axially aligned with outlet plate outlet passage 42. Consequently, imperforate wall 52 laterally directs fuel from outlet plate outlet passage 42 to diverter passage 50.

Diverter plate 34 may also include a plurality of diverter channels 54 which extend laterally across the side of diverter plate 34 which faces toward outlet plate 32 such that each diverter channel 54 provides fluid communication from outlet plate outlet passage 42 to at least one diverter passage 50. Diverter channels 54 may be shaped to be divergent toward diverter passages 50, and as shown, may be dovetail shaped in cross-section. As shown best in FIG. 8, the portion of diverter channels 54 that are axially aligned with diverter passages 50 is closed in the axial direction to the volume between outlet plate 32 and diverter plate 34 while the portion of diverter channels 54 that is not axially aligned with diverter passages 50 is open in the axial direction to the volume between outlet plate 32 and diverter plate 34, thereby requiring fuel to flow laterally through at least a portion of diverter channels 54 in order to reach diverter passages 50.

Diverter plate 34 may also include a contamination trap 56 which is illustrated as a recess in the face of diverter plate 34 that faces toward electric motor 20. Contamination trap 56 is arcuate in shape and has an arc length that is less than 360°. In operation, rotation of electric motor 20 causes the fuel within motor section 14 to swirl around first axis 24 as the fuel flows toward outlet 19. Contamination trap 56 produces a low pressure area which may allow foreign matter present in the fuel to settle and deposit. While contamination trap 56 has been illustrated as being arcuate in shape, it should now be understood that contamination trap 56 may take many forms which may be, by way of non-limiting example, a pattern of square, diamond, or triangles; a series of recessed ribs, or a cross-hatch pattern on the surface of diverter plate 34 that faces toward electric motor 20.

A diverter central aperture 58 extends axially through diverter plate 34 such that diverter central aperture 58 is centered about first axis 24, consequently allowing shaft 22 to extend coaxially through diverter central aperture 58. Diverter central aperture 58 is sealed, for example by engaging outlet plate 32, thereby preventing fuel from passing through diverter central aperture 58. Diverter plate 34 is also sealed on the outer perimeter thereof, for example by engaging a flux carrier of electric motor 20 as shown or alternatively by engaging the inner perimeter of housing 18. In this way substantially all fuel that exits outlet plate outlet passage 42 is laterally directed to and passes through diverter passages 50.

In practice, fuel pump 10 is oriented with pump section 12 facing down, i.e. toward gravity, while outlet 19 is oriented facing up, i.e. away from gravity. Consequently, when fuel pump 10 is not in operation, particulate matter that may be present in motor section 14 tends to settle down toward diverter plate 34. However, since diverter passages 50 are not axially aligned with outlet plate outlet passage 42 of outlet plate 32, the foreign matter that has already passed through diverter passages 50 will not have access to outlet plate outlet passage 42, and consequently, imperforate wall 52 shields outlet plate outlet passage 42 from the foreign matter, thereby preventing the foreign matter from depositing in inner gear rotor 28 and outer gear rotor 30. Furthermore, contamination trap 56 creates an area of stagnation which promotes deposition of foreign matter within contamination trap 56.

In operation, the pumping arrangement comprising inner gear rotor 28 and outer gear rotor 30 generate pressure pulsations. However, diverter plate 34 acts to mitigate the pressure pulsations, thereby minimizing noise generated by fuel pump 10. More specifically, the geometry of diverter channels 54 and diverter passages 50 can be tailored to optimize the mitigation of pressure pulsations, without being bound by theory, by breaking up the pressure pulsations. If mitigating pressure pulsations generated by the pumping arrangement is not an objective, diverter channels 54 may be omitted and diverter passages 50 may be increased in size and decreased in number. Similarly, diverter channels 54 may be omitted depending on the magnitude of pressure pulsation mitigation that is desired since diverter passages 50 may be able to be tailored to provide sufficient mitigation of pressure pulsations alone.

As described herein, diverter plate 34 has been illustrated as a standalone component, however, it should now be understood that diverter plate 34 could alternatively be integrated with other elements of fuel pump 10. By way of non-limiting example only, diverter plate 34 may be integrally formed with a magnet holder of electric motor 20 where the magnet holder is configured to hold permanent magnets that are used to cause rotation of electric motor 20.

As described herein, the pumping arrangement has been illustrated as inner gear rotor 28 and outer gear rotor 30. However, it should now be understood that the pumping arrangement may take other forms which may include, by way of non-limiting example only, an impeller, roller vanes, gears, or vanes.

While this invention has been described in terms of preferred embodiments thereof, it is not intended to be so limited, but rather only to the extent set forth in the claims that follow.

We claim:

1. A fluid pump comprising:

a housing;

an outlet which discharges fluid from said housing;

an inlet plate disposed within said housing, said inlet plate having an inlet which introduces fluid to said housing;

an outlet plate disposed within said housing, said outlet plate having an outlet plate outlet passage;

an electric motor disposed within said housing between said outlet plate and said outlet, said electric motor having a shaft which rotates about an axis;

a pumping arrangement rotationally coupled to said shaft such that rotation of said pumping arrangement by said shaft causes fluid to be pumped from said inlet to said outlet plate outlet passage and through said outlet;

a diverter plate disposed between said outlet plate outlet passage and said electric motor, said diverter plate having a diverter passage which provides fluid communication from said outlet plate outlet passage, past said electric motor, to said outlet, said diverter plate also having an imperforate wall which is axially aligned with said outlet plate outlet passage such that said imperforate wall laterally directs fluid from said outlet plate outlet passage to said diverter passage;

wherein said diverter plate includes a laterally extending diverter channel which provides fluid communication from said outlet plate outlet passage to said diverter passage;

wherein a portion of said diverter channel that is axially aligned with said diverter passage is closed in the axial direction to a volume defined between said outlet plate and said diverter plate while a portion of said diverter channel that is not axially aligned with said diverter passage is open in the axial direction to said volume between said outlet plate and said diverter plate; and wherein said diverter plate includes an outer peripheral surface surrounding said axis and extending axially such that said diverter channel extends to said outer peripheral surface.

2. A fluid pump as in claim 1 wherein said diverter passage extends axially through said diverter plate.

3. A fluid pump as in claim 1 wherein said diverter plate includes a diverter central aperture extending axially therethrough such that said shaft passes through said diverter central aperture, said diverter central aperture being sealed, thereby preventing fluid from passing through said diverter central aperture.

4. A fluid pump as in claim 3 wherein said diverter central aperture is sealed by said diverter plate engaging said outlet plate.

5. A fluid pump as in claim 1 wherein said diverter plate includes a contamination trap in a side of said diverter plate that faces toward said electric motor, said contamination trap being defined by a recess.

6. A fluid pump as in claim 5 wherein said contamination trap is arcuate in shape.

7. A fluid pump as in claim 6 wherein said contamination trap has an arc length that is less than 360°.

8. A fluid pump as in claim 1 wherein said diverter passage is one of a plurality of diverter passages, wherein said imperforate wall laterally directs fluid from said outlet plate outlet passage to each of said plurality of diverter passages.

9. A fluid pump as in claim 8 wherein each of said plurality of diverter passages extends axially through said diverter plate to a side of said diverter plate proximal to said electric motor.

10. A fluid pump as in claim 8 wherein said diverter plate includes a diverter central aperture extending axially therethrough such that said shaft passes through said diverter central aperture, said diverter central aperture being sealed, thereby preventing fluid from passing through said diverter central aperture.

11. A fluid pump as in claim 10 wherein said diverter central aperture is sealed by said diverter plate engaging said outlet plate.

12. A fluid pump as in claim 8 wherein said diverter plate includes a contamination trap in a side of said diverter plate that faces toward said electric motor, said contamination trap being defined by a recess.

13. A fluid pump as in claim 12 wherein said contamination trap is arcuate in shape.

14. A fluid pump as in claim 13 wherein said contamination trap has an arc length that is less than 360°.

15. A fluid pump as in claim 1, wherein said diverter plate includes a wall which is axially aligned with said diverter passage such that said wall of said diverter plate axially blocks axial communication between said diverter passage and said volume between said outlet plate and said diverter plate.

16. A fluid pump comprising:

a housing;

an outlet which discharges fluid from said housing;

an inlet plate disposed within said housing, said inlet plate having an inlet which introduces fluid to said housing;

an outlet plate disposed within said housing, said outlet plate having an outlet plate outlet passage;

an electric motor disposed within said housing between said outlet plate and said outlet, said electric motor having a shaft which rotates about an axis;

a pumping arrangement rotationally coupled to said shaft such that rotation of said pumping arrangement by said shaft causes fluid to be pumped from said inlet to said outlet plate outlet passage and through said outlet;

a diverter plate disposed between said outlet plate outlet passage and said electric motor, said diverter plate having a diverter passage which provides fluid communication from said outlet plate outlet passage, past said electric motor, to said outlet, said diverter plate also having an imperforate wall which is axially aligned with said outlet plate outlet passage such that said imperforate wall laterally directs fluid from said outlet plate outlet passage to said diverter passage;

wherein said diverter plate includes a laterally extending diverter channel which provides fluid communication from said outlet plate outlet passage to said diverter passage;

wherein a portion of said diverter channel that is axially aligned with said diverter passage is closed in the axial direction to a volume defined between said outlet plate and said diverter plate while a portion of said diverter channel that is not axially aligned with said diverter passage is open in the axial direction to said volume between said outlet plate and said diverter plate; and wherein said diverter channel has a width perpendicular to said axis such that said width diverges along a path parallel to said axis toward said diverter passage.

17. A fluid pump as in claim 16 wherein said diverter channel diverges axially toward said diverter passage.

18. A fluid pump comprising:

a housing;

an outlet which discharges fluid from said housing;

an inlet plate disposed within said housing, said inlet plate having an inlet which introduces fluid to said housing;

an outlet plate disposed within said housing, said outlet plate having an outlet plate outlet passage;

an electric motor disposed within said housing between said outlet plate and said outlet, said electric motor having a shaft which rotates about an axis;

a pumping arrangement rotationally coupled to said shaft such that rotation of said pumping arrangement by said shaft causes fluid to be pumped from said inlet to said outlet plate outlet passage and through said outlet; and a diverter plate disposed between said outlet plate outlet passage and said electric motor, said diverter plate having a diverter passage which provides fluid communication from said outlet plate outlet passage, past said electric motor, to said outlet, said diverter plate also having an imperforate wall which is axially aligned with said outlet plate outlet passage such that said imperforate wall laterally directs fluid from said outlet plate outlet passage to said diverter passage;

wherein a portion of said diverter channel that is axially aligned with said diverter passage is closed in the axial direction to a volume defined between said outlet plate and said diverter plate while a portion of said diverter channel that is not axially aligned with said diverter passage is open in the axial direction to said volume between said outlet plate and said diverter plate;

wherein said diverter passage is one of a plurality of diverter passages, wherein said imperforate wall laterally directs fluid from said outlet plate outlet passage to each of said plurality of diverter passages; and wherein said diverter plate includes a plurality of laterally extending diverter channels which provide fluid communication from said outlet plate outlet passage to said plurality of diverter passages.

19. A fluid pump as in claim 18 wherein each of said plurality of diverter channels diverges toward respective ones of said plurality of diverter passages to which respective ones of said plurality of diverter channels provide fluid communication from said outlet plate outlet passage.

20. A fluid pump as in claim 19 wherein each of said plurality of diverter channels diverges axially toward respective ones of said plurality of diverter passages to which respective ones of said plurality of diverter channels provide fluid communication from said outlet plate outlet passage.

21. A fluid pump as in claim 18 wherein a portion of each of said plurality of diverter channels that is axially aligned with respective ones of said plurality of diverter passages is closed in the axial direction to a volume defined between said outlet plate and said diverter plate while a portion of each of said plurality of diverter channels that is not axially aligned with respective ones of said plurality of diverter passage is open in the axial direction to said volume between said outlet plate and said diverter plate.

* * * * *